US007213303B1

(12) United States Patent
Savicki

(10) Patent No.: US 7,213,303 B1
(45) Date of Patent: May 8, 2007

(54) CLOSURE DEVICE

(75) Inventor: Alan F. Savicki, Oswego, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 09/979,527

(22) PCT Filed: Jun. 10, 1999

(86) PCT No.: PCT/US99/13212

§ 371 (c)(1),
(2), (4) Date: Nov. 19, 2001

(87) PCT Pub. No.: WO00/76341

PCT Pub. Date: Dec. 21, 2000

(51) Int. Cl.
*A44B 19/16* (2006.01)

(52) U.S. Cl. ..... 24/30.5; 24/585.1; 24/61.2; 24/387; 24/399; 383/64

(58) Field of Classification Search ..... 24/30.5 R, 24/399, 400, 387, 388, 427, 428, 585.1; 383/64, 383/61.2, 63
See application file for complete search history.

(56) References Cited

U.S. PATENT DOCUMENTS

| | | | | |
|---|---|---|---|---|
| 2,960,561 | A | | 11/1960 | Plummer |
| 3,198,228 | A | | 8/1965 | Kakuji Naito |
| 4,199,845 | A | | 4/1980 | Ausnit |
| 4,736,496 | A | | 4/1988 | Fisher et al. |
| 4,829,641 | A | | 5/1989 | Williams |
| 5,007,142 | A | | 4/1991 | Herrington |
| 5,007,143 | A | | 4/1991 | Herrington |
| 5,010,627 | A | | 4/1991 | Herrington et al. |
| 5,020,194 | A | | 6/1991 | Herrington et al. |
| 5,067,208 | A | * | 11/1991 | Herrington, Jr. et al. ..... 24/400 |
| 5,070,583 | A | | 12/1991 | Herrington |
| 5,088,971 | A | | 2/1992 | Herrington |
| 5,131,121 | A | | 7/1992 | Herrington, Jr. et al. |
| 5,161,286 | A | | 11/1992 | Herrington, Jr. et al. |
| 5,189,764 | A | * | 3/1993 | Herrington et al. ..... 24/384 |
| 5,301,394 | A | | 4/1994 | Richardson et al. |
| 5,301,395 | A | | 4/1994 | Richardson et al. |
| 5,363,540 | A | | 11/1994 | Dais et al. |
| 5,405,478 | A | * | 4/1995 | Richardson et al. ..... 156/308.4 |

(Continued)

FOREIGN PATENT DOCUMENTS

FR 1564039 4/1969

*Primary Examiner*—Robert J. Sandy
*Assistant Examiner*—Marcus Menezes
(74) *Attorney, Agent, or Firm*—Thomas C. Feix

(57) ABSTRACT

A closure device (100) is provided for use with storage containers (50), such as plastic bags. The closure device (100) includes interlocking fastening strips (120, 130) having first and second ends and a slider member (200) movably installed upon the interlocking fastening strips to facilitate the occlusion and deocclusion thereof. The slider member (200) includes a pair of spaced-apart side walls (210, 220) which are positioned on opposite sides of the interlocking fastening strips (120, 130) and an intermediate body portion (240) therebetween which is positioned upon the interlocking fastening strips. The slider member (200) also includes notches (250, 260) formed therein which are adapted to engage cooperating protrusions (280, 290) formed on the interlocking fastening strips (120, 130) at the first and second ends (111, 112) thereof to obstruct movement of the slider member (200) beyond the first and second ends (111, 112).

60 Claims, 5 Drawing Sheets

U.S. PATENT DOCUMENTS 5,426,830 A 6/1995 Richardson et al.
5,431,760 A 7/1995 Donovan
5,442,837 A 8/1995 Morgan
5,442,838 A 8/1995 Richardson et al.
5,448,808 A 9/1995 Gross
5,664,299 A 9/1997 Porchia et al.
5,924,173 A * 7/1999 Dobreski et al. ..... 24/400
5,956,815 A * 9/1999 O'Connor et al. ..... 24/30.5 R
6,306,071 B1 * 10/2001 Tomic ..... 493/213
2002/0154836 A1 * 10/2002 Kinigakis et al. ..... 383/64

* cited by examiner

CLOSURE DEVICE

FIELD OF THE INVENTION

The present invention relates generally to closure devices and, more particularly, to a closure device having interlocking fastening strips and a cooperating slider member movably installed upon the fastening strips. The inventive closure device may be employed in traditional fastener areas and is particularly well suited for fastening flexible storage containers, such as plastic bags.

BACKGROUND OF THE INVENTION

The use of closure devices for selectively fastening storage containers, including plastic bags, is generally well known. Furthermore, the manufacture of closure devices made of plastic materials is generally well known to those skilled in the art, as demonstrated by the numerous patents in this area.

A particularly well-known use for closure devices is in connection with flexible storage containers, such as plastic bags. Such closure devices provide a convenient way to selectively close or seal the bag in order to retain matter therein.

Conventional closure devices typically utilize mating fastening strips or closure elements which are used to selectively seal the bag. With such closure devices, however, it is often difficult to determine whether the fastening strips are fully occluded. This problem is particularly acute when the fastening strips are relatively narrow. Accordingly, when such fastening strips are employed, there exists a reasonable likelihood that the closure device is at least partially open.

Such fastening strips are particularly difficult to manipulate or handle by individuals with limited manual dexterity. Thus, in order to assist these individuals and for ease of use by individuals with normal dexterity, the prior art has provided sliders for use in opening and closing the fastening strips, as disclosed, for example, in U.S. Pat. Nos. 4,199,845, 5,007,142, 5,007,143, 5,010,627, 5,020,194, 5,070,583, 5,283,932, 5,301,394, 5,426,830, 5,431,760, 5,442,838, and 5,448,808. Some of these sliders include a separator finger which extends at least partially between the fastening strips. When the slider is moved in the appropriate direction, the separator finger divides the fastening strips and opens the bag.

While the use of a slider certainly facilitates the opening and closing of interlocking fastening strips, there are certain difficulties involved with preventing movement of the slider beyond the ends of the fastening strips. In an attempt to rectify some of these difficulties, the prior art has provided end stops at either end of the fastening strips, as disclosed, for example, in U.S. Pat. Nos. 5,088,971, 5,131,121, and 5,405,478. Such end stops, however, suffer from assorted deficiencies including, for example, a relatively complex construction, a high relative cost, and a design which permits the slider to be pulled past the end stops and detached from the fastening strips if a sufficient pulling force is applied thereto. Specifically, in some prior art designs, a sufficient pulling force will cause the end stop to deflect or tear, and the slider will be able to move past the end stop and past the end of the fastening strips.

OBJECTS OF THE INVENTION

Accordingly, a general object of the present invention is to provide a closure device comprised of interlocking fastening strips and a slider member which overcomes deficiencies in the prior art.

A more specific object of the present invention is to provide a slider member for a closure device which is more difficult to pull off of, or detach from, the ends of interlocking fastening strips.

A related object of the present invention is to provide a slider member for a closure device which includes notches that engage cooperating protrusions formed on the ends of interlocking fastening strips to obstruct movement of the slider member beyond the ends of the strips.

A further object of the present invention is to provide a closure device as characterized above which operates in a simple and economical manner.

An additional object of the present invention is to provide a closure device as characterized above which is relatively simple and economical in construction, and which lend itself to reliable operation and use.

SUMMARY OF THE INVENTION

In accordance with these and other objects, a closure device is provided for use with storage containers, such as plastic bags. The closure device comprises interlocking fastening strips having first and second ends and a slider member movably installed upon the interlocking fastening strips to facilitate the occlusion and deocclusion thereof. The slider member includes a pair of spaced-apart side walls which are positioned on opposite sides of the interlocking fastening strips and an intermediate body portion therebetween which is positioned upon the interlocking fastening strips. The slider member also includes notches formed therein which are adapted to engage cooperating protrusions formed on the interlocking fastening strips at the first and second ends thereof to obstruct movement of the slider member beyond the first and second ends.

These and other objects, features, and advantages of the present invention will become more readily apparent upon reading the following detailed description of the illustrated embodiments and upon reference to the accompanying drawings wherein:

Figure 1:
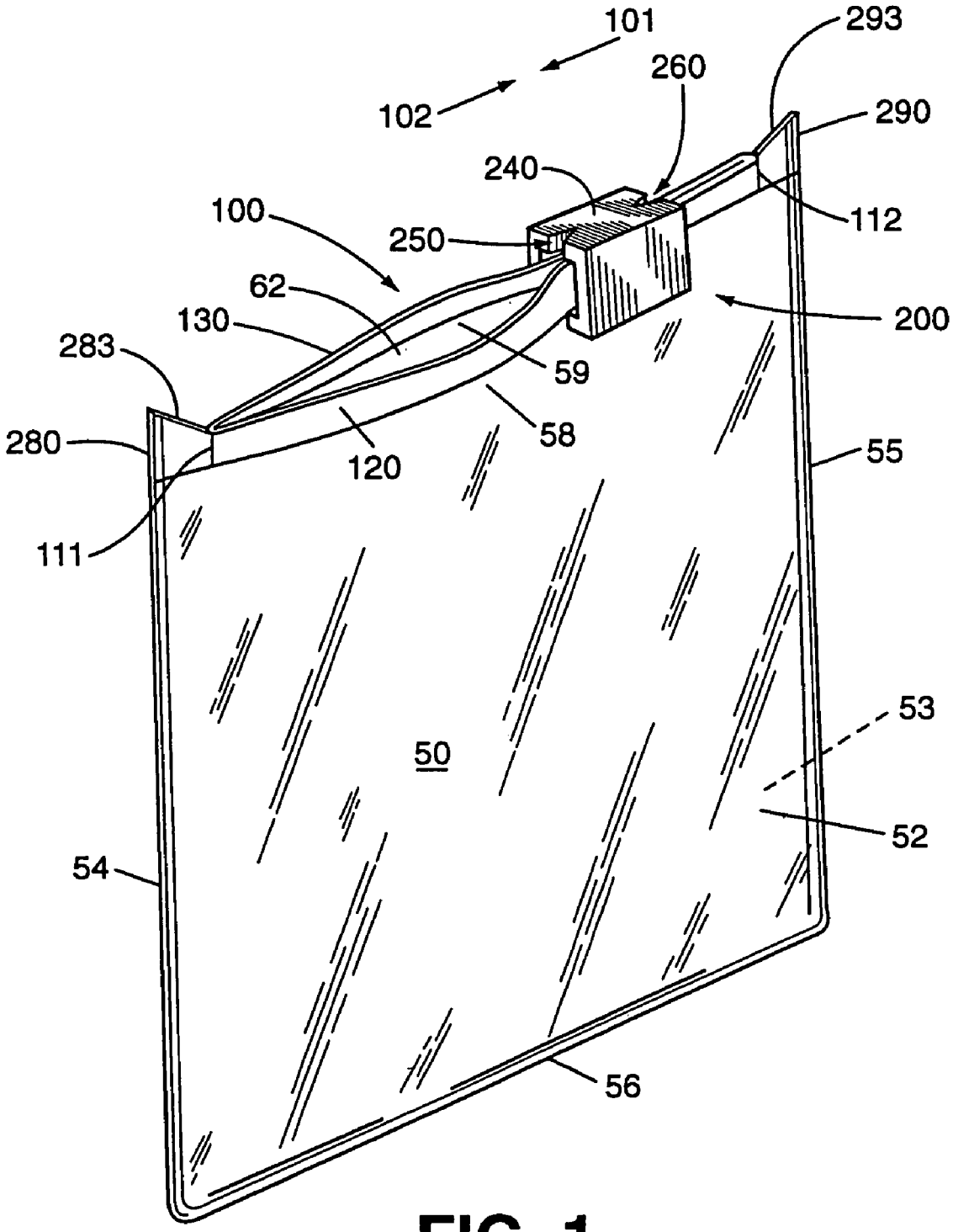
FIG. 1 is a perspective view of a storage container in the form of a plastic bag utilizing a closure device comprised of interlocking fastening strips and a cooperating slider member and having protrusions and notches, respectively, in accordance with a first embodiment of the present invention.

While the present invention is susceptible to various modifications and alternative constructions, certain illustrated embodiments thereof have been shown in the drawings and will be described in detail below. It should be understood, however, that there is no intention to limit the present invention to the disclosed structural forms. On the contrary, the intention is to cover all modifications, alternative constructions, and equivalents that fall within the spirit and scope of the present invention as defined by the appended claims.

DETAILED DESCRIPTION OF THE ILLUSTRATED EMBODIMENTS

Turning now to the drawings, and more particularly to FIG. 1, a closure device constructed in accordance with the present invention is generally designated by reference numeral 100. The closure device 100 is intended for use with a storage container 50, such as a conventional plastic bag, which includes a pair of complementary sheets or opposing flexible side panels 52, 53 attached at their lateral sides 54, 55 and bottom 56 to form a storage compartment. The complementary side panels 52, 53 are also unattached at their upper edge portions 58, 59 to form a mouth 62 for the storage container 50. Although a rectangularly-shaped storage container or bag 50 is specifically illustrated herein, it will be readily appreciated by those skilled in the art that other bag configurations may alternatively be employed without departing from the scope or spirit of the present invention.

As shown in FIG. 1, the closure device 100 includes a pair of interlocking fastening strips 120, 130 which are disposed along respective upper edge portions 58, 59 of the opposing side panels or sheets 52, 53. The closure device 100 also includes a slider member 200 which is movably installed upon the interlocking fastening strips 120, 130. More specifically, the first fastening strip 120 is attached to the upper edge portion 58 of one of the side panels 52, the second fastening strip 130 is attached to the upper edge portion 59 of the other side panel 53, and the slider member 200 is carried by the first and second fastening strips 120, 130 in a slidable manner.

While the drawings show the fastening strips 120, 130 in a rather schematic fashion, those skilled in the art will readily appreciate that the interlocking fastening strips 120, 130 may take virtually any form. By way of non-limiting example, the interlocking fastening strips 120, 130 may comprise: (1) U-channel closure strips, as disclosed in U.S. Pat. No. 4,829,641; (2) shear action or Z-axis closure strips, as disclosed in PCT Patent Application Serial No. PC/US99/13246 (applicant's File Reference 178590); (3) arrowhead-type closure strips, as disclosed in U.S. Pat. No. 3,198,228 (which reissued as Re. 28,969), U.S. Pat. Nos. 4,736,496, and 5,363,540; (4) "rolling action" closure strips, as disclosed in U.S. Pat. No. 5,007,143; or (5) "profile" closure strips, as disclosed in U.S. Pat. No. 5,664,299. All of the above-identified patents and applications are hereby incorporated by reference in their entireties.

In operation, the slider member 200 facilitates the occlusion of the interlocking fastening strips 120, 130 when moved towards a first end 111 thereof, and facilitates the deocclusion of the interlocking fastening strips 110 when moved towards a second end 112 thereof. For instance, when the slider member 200 is moved in an occlusion direction, as indicated by reference numeral 101 in FIGS. 1–5, it facilitates occlusion of the fastening strips 120, 130. Conversely, when the slider member 200 is moved in a deocclusion direction, as indicated by reference numeral 102 in FIGS. 1–5, it facilitates the deocclusion of the fastening strips 120, 130.

Figure 6:
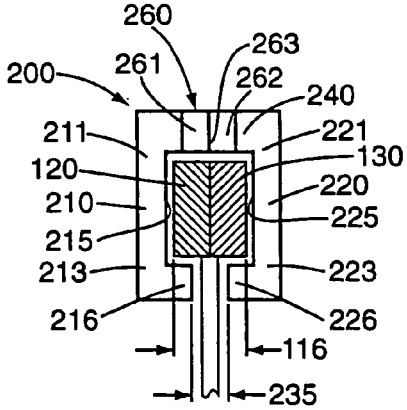
FIG. 6 is a cross-sectional view of the closure device, as seen substantially in the direction of line 6—6 in FIG. 5.

The slider member 200 includes a pair of spaced-apart side walls 210, 220 which are adapted to be positioned on opposite sides of the interlocking fastening strips 120, 130, as shown, for example, in FIG. 6, and an intermediate body portion 240 between the side walls 210, 220 which is adapted to be positioned upon and installed above the interlocking fastening strips 120, 130. More specifically, the intermediate body portion 240 is integrally connected to or combined with upper ends 211, 221 of the spaced-apart side walls 210, 220. On account of this construction, the slider member 200 has a generally inverted U-shaped configuration when viewed from the front and rear.

In order to restrict removal of the slider member 200 from the interlocking fastening strips 120, 130, the side walls 210, 220 each have interior surfaces 215, 225 with inwardly projecting shoulders 216, 226 formed thereon. As shown in FIG. 6, these shoulders 216, 226 are formed at lower ends 213, 223 of the side walls 210, 220 and are separated by a gap 235 which is smaller than the width 116 of the interlocking fastening strips 120, 130.

In keeping with an important aspect of the present invention, the slider member 200 also includes notches which are adapted to interact with and cooperatively engage protrusions formed on at least one the interlocking fastening strips 120, 130 to obstruct movement of the slider member 200 beyond the first and second ends 111, 112 of the fastening strips 120, 130. As will be described more fully below, several different embodiments of notches and cooperating protrusions are disclosed herein at FIGS. 1–6, 7–9, 10–11, and 12–14, respectively. While the protrusions disclosed herein are formed on both interlocking fastening strips 120, 130, those skilled in the art will appreciate that the protrusions may alternatively be formed on only one of the fastening strips 120, 130 without departing from the scope or spirit of the present invention.

Figure 2:
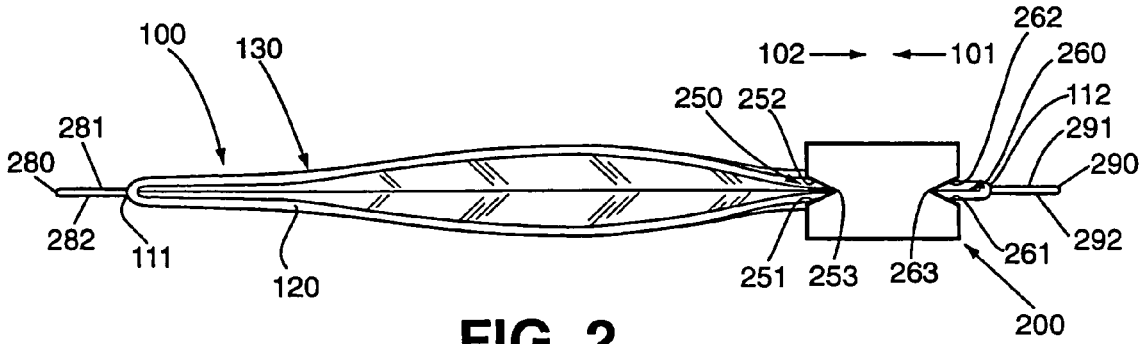
FIG. 2 is a top plan view of the closure device depicted in FIG. 1, showing the interlocking fastening strips in an open or deoccluded condition and the slider member proximate to one end of the fastening strips.
Figure 3:
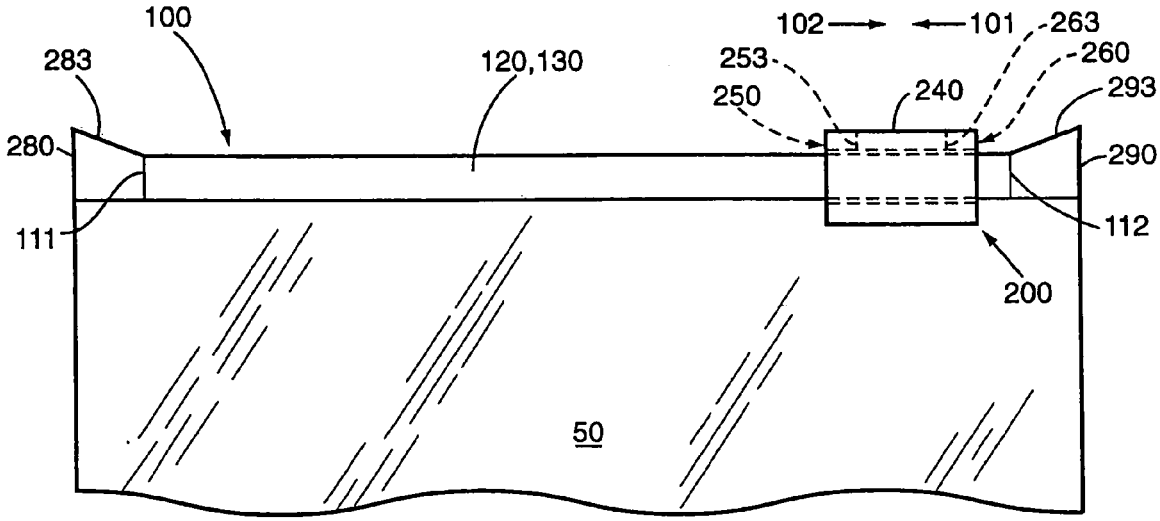
FIG. 3 is a fragmentary side elevational view of the closure device depicted in FIG. 2.
Figure 4:
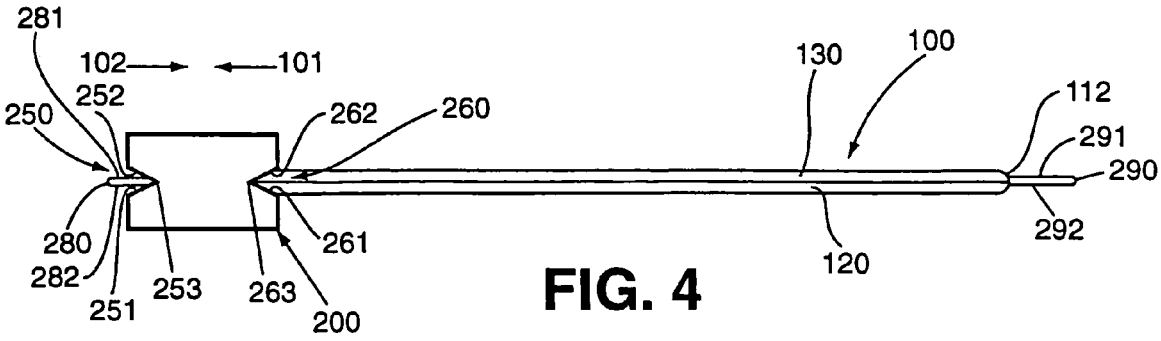
FIG. 4 is a top plan view of the closure device depicted in FIG. 1, showing the interlocking fastening strips in a closed or occluded condition, the slider member at the other end of the fastening strips, and one of the notches of the slider member cooperatively engaging one of the protrusions to obstruct movement of the slider member beyond that end of the fastening strips.

In a first embodiment, a pair of notches 250, 260 are formed in the intermediate body portion 240 of slider member 200 at opposite ends thereof, as shown, for example, in FIGS. 1–6. These notches 250, 260 are adapted to cooperatively engage a pair of protrusions 280, 290 formed on the interlocking fastening strips 120, 130 at the first and second ends 111, 112 thereof. In this embodiment, the notches 250, 260 are generally V-shaped or triangular in configuration when viewed from above, as shown in FIGS. 2 and 4, and the cooperating protrusions 280, 290 are generally planar or flat in configuration.

The two generally V-shaped notches 250, 260 each extend through the intermediate body portion 240 of the slider member 200, as shown, for example, in FIG. 1. In addition, the two notches 250, 260 each have a pair of opposed interior sides or faces 251, 252, 261, 262 which converge along generally vertical internal corners 253, 263, as shown in FIGS. 2–5. In this embodiment, the interior sides 251, 252, 261, 262 of the notches 250, 260 are substantially planar or flat and have generally rectangular configurations.

The protrusions 280, 290 formed at the first and second ends 111, 112 of the interlocking fastening strips 110 each have a pair of opposed exterior sides 281, 282, 291, 292 and a top intermediate edge portion 283, 293 therebetween. In this embodiment, the edge portions 283, 293 of the protrusions 280, 290 are each inclined with respect to the interlocking fastening strips 120, 130. More specifically, the two edge portions 283, 293 each slope upwardly and outwardly with respect to the interlocking fastening strips 120, 130, as shown, for example, in FIGS. 1, 3, and 5. On account of this construction, the opposed exterior sides 281, 282, 291, 292 of the protrusions 280, 290 are substantially parallel with respect to each other and have upper end portions which are generally triangular in configuration.

Figure 5:
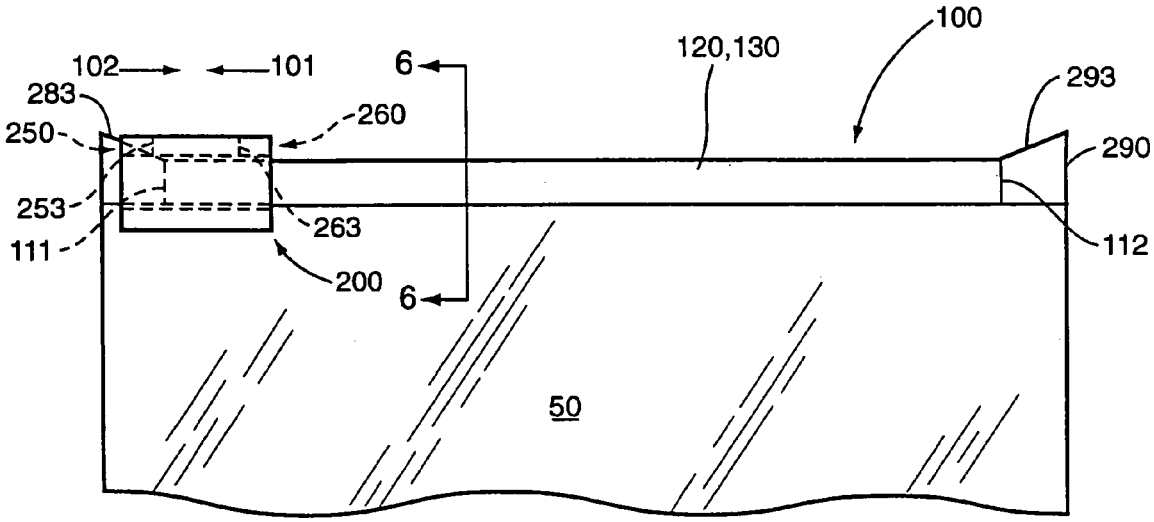
FIG. 5 is a fragmentary side elevational view of the closure device depicted in FIG. 4.

In usage, the notches 250, 260 of the slider member 200 interact with and cooperatively engage the protrusions 280, 290 of the interlocking fastening strips 120, 130 to obstruct movement of the slider member 200 beyond the first and second ends 111, 112 of the fastening strips. For example, when the slider member 200 is moved toward the first end 111 of the interlocking fastening strips 120, 130, the first notch 250 of the slider member 200 receives the protrusion 280 formed at the first end 111 of the fastening strips 120, 130, as shown in FIGS. 4 and 5, to impede or block any further movement of the slider member 200 in the occlusion direction 101. More specifically, the opposed exterior sides 281, 282 of protrusion 280 become wedged between the opposed interior sides 251, 252 of notch 250 in the vicinity of internal corner 253 which restricts the slider member 200 from moving beyond the first end 111 of the strips 120, 130. When the slider member 200 is moved toward the second end 112 of the interlocking fastening strips 120, 130, conversely, the second notch 260 of the slider member 200 receives the protrusion 290 formed at the second end 112 of the fastening strips 120, 130 to impede or block any further movement of the slider member 200 in the deocclusion direction 102. As with protrusion 280, the opposed exterior sides 291, 292 of protrusion 290 become wedged between the opposed interior sides 261, 262 of notch 260 in the vicinity of internal corner 263 which restricts the slider member 200 from moving beyond the second end 112 of the strips 120, 130. In either event, this positive interactive engagement between the notches 250, 260 of the slider member 200 and the protrusions 280, 290 of the interlocking fastening strips 120, 130 prevents the slider member 200 from being pulled off of the first and second ends 111, 112 of the fastening strips 120, 130.

Figure 9:
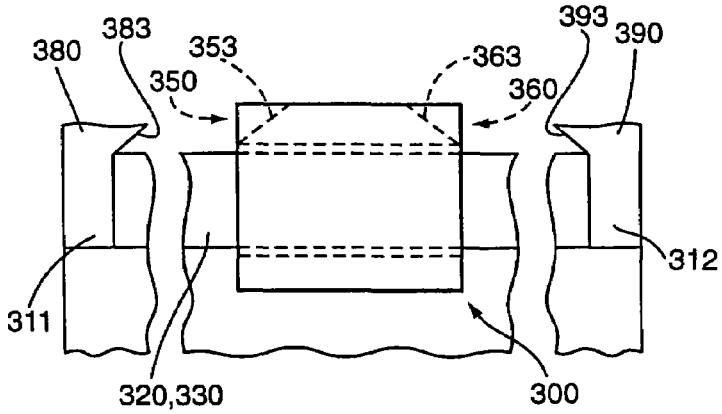
FIG. 9 is a fragmentary side elevational view of the closure device, as seen substantially in the direction of line 9—9 in FIG. 7.

While engagement between the notches 250, 260 and protrusions 260, 270 certainly helps prevent detachment of the slider member 200 from the first and second ends 111, 112 of the interlocking fastening strips 120, 130, those skilled in the art will appreciate that the notches 250, 260 and protrusions 260, 270 may take other forms or have alternative configurations than those shown without departing from the scope or spirit of the present invention. For example, instead of sloping upwardly and outwardly away from the center of the interlocking fastening strips 110, the intermediate edge portions of the protrusions may instead be arranged generally perpendicular to the fastening strips as shown, for example, in FIG. 11 or slope upwardly and inwardly toward the center of the fastening strips as shown in FIG. 9. Still other embodiments of the notches and protrusions will be described more fully below.

Figure 7:
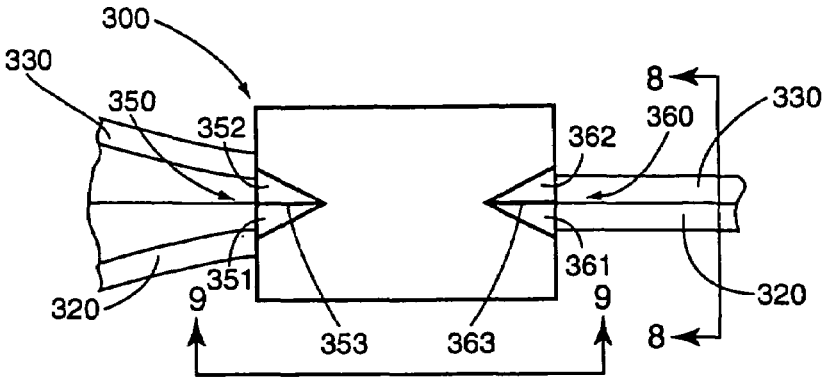
FIG. 7 is a fragmentary top plan view of a closure device comprised of interlocking fastening strips and a cooperating slider member having notches in accordance with a second embodiment of the present invention.
Figure 8:
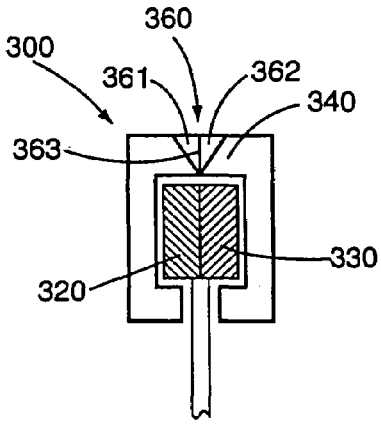
FIG. 8 is a cross-sectional view of the closure device, as seen substantially in the direction of line 8—8 in FIG. 7.

In a second embodiment, a pair of notches 350, 360 are formed in the intermediate body portion 340 of slider member 300 at opposite ends thereof, as shown, for example, in FIGS. 7–9. As with the first embodiment, these two notches 350, 360 selectively interact with and cooperatively engage protrusions 380, 390 formed on the interlocking fastening strips 320, 330 at the first and second ends 311, 312 thereof. When the notches 350, 360 engage these protrusions, the slider member 300 is obstructed from moving beyond the first and second ends 311, 312 of the fastening strips 320, 330.

In this embodiment, the notches 350, 360 of the slider member 300 each have a pair of opposed interior sides or faces 351, 352, 361, 362 which are substantially planar or flat and have generally triangular configurations. As best shown in FIG. 9, these opposed interior sides 351, 352, 361, 362 also converge along inclined internal edges 353, 363 which slope upwardly and inwardly with respect to the intermediate body portion 340 of the slider 300. On account of this construction, the notches 350, 360 are generally V-shaped or triangular in configuration when viewed from above, as shown in FIG. 7, and when viewed from the ends, as shown in FIG. 8.

As shown in FIG. 9, the protrusions 380, 390 have respective edge portions 383, 393 which slope upwardly and inwardly toward the center of the fastening strips 320, 330 in a substantially parallel manner with respect to the inclined internal edges 353, 363 of the two notches 350, 360. Those skilled in the art will appreciate that the protrusions formed at the first and second ends 311, 312 of the interlocking fastening strips 320, 330 may take virtually any form, including, for example, the protrusions 280, 290 shown in FIGS. 1–5.

Figure 10:
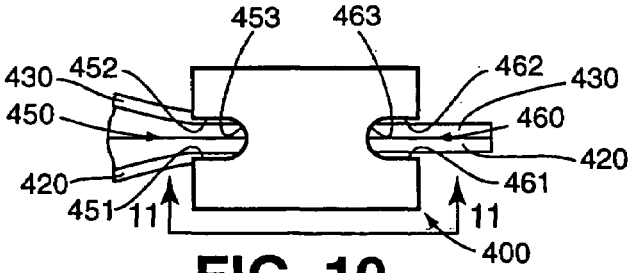
FIG. 10 is a top plan view of a slider member having notches in accordance with a third embodiment of the present invention.

In a third embodiment, a pair of partially curved notches 450, 460 are formed in the intermediate body portion of slider member 400, as shown, for example, in FIG. 10. In this embodiment, each notch 450, 460 includes a pair of spaced-apart interior sides or faces 451, 452, 461, 462 with an intermediate arcuate portion 453, 463 located internally therebetween. While other configurations are permissible and would certainly fall within the scope and spirit of the present invention, the opposed interior sides 451, 452, 461, 462 of the illustrated notches 450, 460 are substantially parallel with respect to each other.

Figure 11:
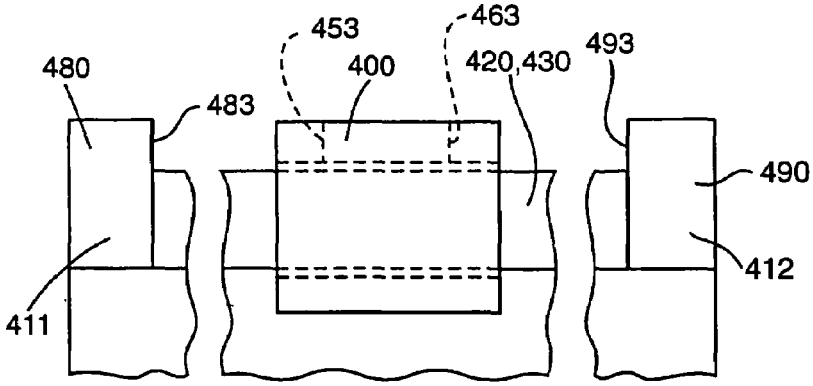
FIG. 11 is a fragmentary side elevational view of the closure device, as seen substantially in the direction of line 11—11 in FIG. 10.

In usage, the notches 450, 460 of the slider member 400 are adapted to engage cooperating protrusions 480, 490 formed on the interlocking fastening strips 420, 430 at the first and second ends 411, 412 thereof as shown in FIG. 11.

The protrusions 480, 490 have edge portions 483, 493 which are arranged generally perpendicular to the fastening strips 420, 430. More specifically, when the slider member 400 is moved toward the first and second ends 411, 412 of the fastening strips 420, 430, the opposed interior sides 451, 452, 461, 462 of the notches 450, 460 are positioned to receive the protrusions 480, 490 therebetween, and the intermediate arcuate portions 453, 463 of the notches 450, 460 are positioned to engage the protrusions 480, 490 in a blocking or impeding manner. Thus, when the arcuate portions 453, 463 of these notches 450, 460 engage the protrusions 480, 490, the slider member 400 is advantageously obstructed from moving beyond the first and second ends 411, 412 of the fastening strips 420, 430.

Those skilled in the art will appreciate that the protrusions formed at the first and second ends 411, 412 of the interlocking fastening strips 420, 430 may take virtually any form, including, for example, the protrusions 280, 290 shown in FIGS. 1–5. In this example, the protrusions would have edge portions which slope upwardly and outwardly with respect to the interlocking fastening strips in a similar manner to the edge portions 283, 293 of protrusions 280, 290. In other examples, the protrusions could have edge portions which slope upwardly and inwardly toward the center of the fastening strips as shown, for example, in FIG. 9.

Figure 12:
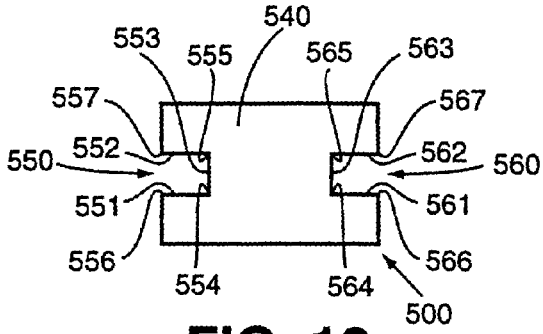
FIG. 12 is a top plan view of a slider member having notches in accordance with a fourth embodiment of the present invention.
Figure 13:
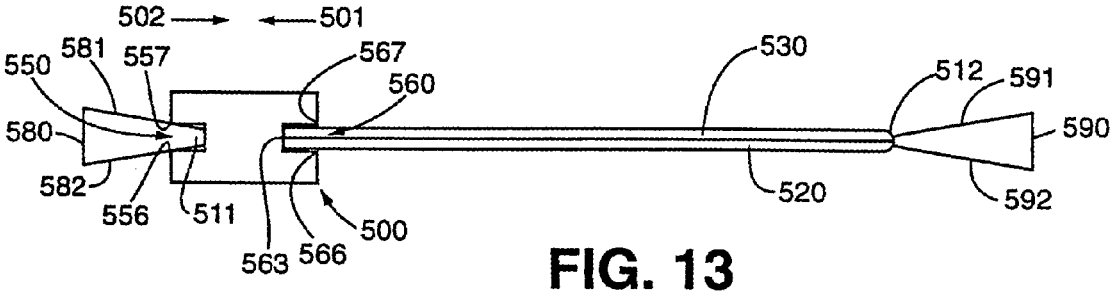
FIG. 13 is a top plan view of a closure device comprised of interlocking fastening strips and the slider member depicted in FIG. 12, and showing the interlocking fastening strips in a closed or occluded condition, the slider member at an end of the fastening strips, and one of the notches of the slider member cooperatively engaging a protrusion formed at that end of the fastening strips to obstruct movement of the slider member beyond that end.
Figure 14:
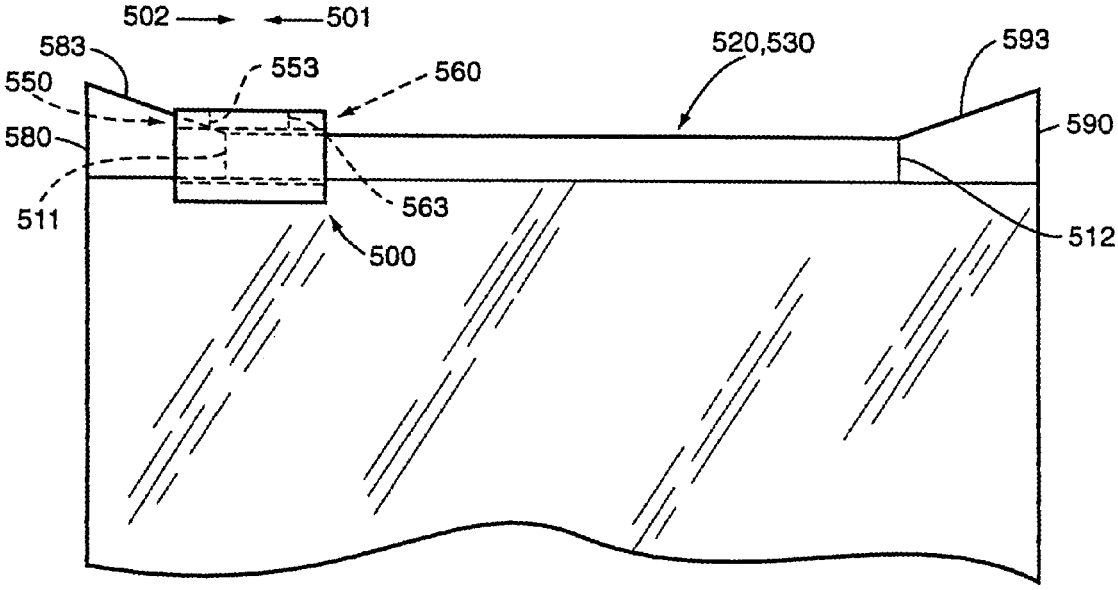
FIG. 14 is a fragmentary side elevational view of the closure device depicted in FIG. 13.

In yet another embodiment, a pair of notches 550, 560 are formed in the intermediate body portion 540 of slider member 500, as shown, for example, in FIG. 12, and a pair of cooperating protrusions 580, 590 are formed on the interlocking fastening strips 520, 530 at the first and second ends 511, 512 thereof, as shown, for example, in FIGS. 13 and 14. In this embodiment, the notches 550, 560 are generally box-shaped or rectangular in configuration when viewed from above, as shown in FIGS. 12 and 13, and the cooperating protrusions 580, 590 are generally triangular or wedge-shaped in configuration when viewed from above, as shown in FIG. 13.

As best shown in FIG. 12, the generally rectangular shaped notches 550, 560 each have a pair of opposed interior sides or faces 551, 552, 561, 562 with an intermediate portion 553, 563 located internally therebetween. In this embodiment, the interior sides 551, 552, 561, 562 and the intermediate portions 553, 563 of the notches 550, 560 are substantially planar or flat and have generally rectangular configurations. Also, the opposed interior sides 551, 552, 561, 562 of each notch 550, 560 are arranged substantially parallel to each other, but substantially perpendicular to intermediate portion 553, 563. On account of this construction, the opposed interior sides 551, 552, 561, 562 of each notch 550, 560 converge with the intermediate portions 553, 563 along substantially vertical internal corners 554, 555, 564, 565. In addition, the opposed interior sides 551, 552, 561, 562 of each notch 550, 560 also have substantially vertical external corners 556, 557, 566, 567.

The generally wedge-shaped protrusions 580, 590 formed at the first and second ends 511, 512 of the interlocking fastening strips 520, 530 each have a pair of opposed exterior sides-581, 582, 591, 592 and a top intermediate edge portion 583, 593 therebetween. In this embodiment, the opposed exterior sides 581, 582, 591, 592 of the protrusions 580, 590 flare outwardly with respect to each other and the interlocking fastening strips 520, 530, as shown, for example, in FIG. 13. In addition, the top intermediate edge portions 583, 593 of the protrusions 580, 590 each slope upwardly and outwardly with respect to the interlocking fastening strips 520, 530, as shown, for example, in FIG. 14.

In usage, the notches 550, 560 of the slider member 500 interact with and cooperatively engage the protrusions 580, 590 formed on the interlocking fastening strips 520, 530 to obstruct movement of the slider member 500 beyond the first and second ends 511, 512 thereof. For example, when the slider member 500 is moved toward the first end 511 of the interlocking fastening strips 520, 530, the first notch 550 of the slider member 500 receives the protrusion 580 formed at the first end 511 of the fastening strips 520, 530, as shown in FIGS. 13 and 14, to impede or block any further movement of the slider member 500 in the occlusion direction 501. More specifically, the opposed exterior sides 581, 582 of protrusion 580 become wedged between the external corners 556, 557 of notch 550, as shown in FIG. 13, and the upwardly sloping edge portion 583 of protrusion 580 engages the intermediate portion 553 of notch 550, as shown in FIG. 14, to restrict movement of the slider member 500 beyond the first end 511 of the fastening strips 520, 530. When the slider member 500 is moved toward the second end 512 of the interlocking fastening strips 520, 530, conversely, the second notch 560 of the slider member 500 receives the protrusion 590 formed at the second end 512 of the fastening strips 520, 530 to impede or block any further movement of the slider member 500 in the deocclusion direction 502. As with protrusion 580, the opposed exterior sides 591, 592 of protrusion 590 become wedged between the external corners 566, 567 of notch 550 and the upwardly sloping edge portion 593 of protrusion 590 engages the intermediate portion 563 of notch 560 to restrict movement of the slider member 500 beyond the second end 512 of the fastening strips 520, 530. In either event, this positive interactive engagement between the notches 550, 560 of the slider member 500 and the protrusions 580, 590 of the interlocking fastening strips 520, 530 advantageously prevents the slider member 500 from being pulled off of or detached from the first and second ends 511, 512 of the fastening strips 520, 530.

While several different notch and protrusion embodiments have been specifically described and illustrated herein, those skilled in the art will appreciate that these particular embodiments have been provided for illustrative purposes only, and do not represent an exhaustive register of each and every notch and protrusion covered by the present invention. Indeed, other types, kinds, versions, and forms of notches and protrusions may alternatively be employed without departing from the scope or spirit of the present invention. In other embodiments, for example, the notches may be formed in one or both of the side walls 210, 220 of the slider member 200, instead of the intermediate body portion 230, and engage cooperating protrusions that project outwardly from the first and second ends 111, 112 of the interlocking fastening strips 120, 130 in a substantially perpendicular manner with respect to the opposing flexible side panels 52, 53.

The slider member may be formed from a suitable plastic material such as nylon, polypropylene, polystyrene, acetal, toughened acetal, polyketone, polybutylene terrephthlate, high density polyethylene, polycarbonate, ABS (acrylonitrile-butadiene-styrene), or the like. In addition, the slider member may also have either a colored, opaque, translucent or transparent appearance.

As will be readily appreciated by those skilled in the art, the slider member may be utilized with any type of interlocking fastening strips. The slider member may also have a separator finger which extends downwardly from the intermediate body portion and at least partially between the interlocking fastening strips. In use, this finger provides for the separation of the fastening strips when the slider member is moved in the deocclusion direction, as disclosed, for example, in U.S. Pat. Nos. 5,007,142, 5,007,143, 5,010,627, 5,020,194, 5,067,208, 5,070,583, 5,088,971, 5,131,121, 5,161,286, 5,189,764, 5,282,932, 5,301,395, 5,426,830, 5,448,808, and 5,442,837.

The interlocking fastening strips may be manufactured by extrusion through a die. In addition, the fastening strips may be manufactured to have approximately uniform cross-sections. This not only simplifies the manufacturing of the closure device, but also contributes to the physical flexibility of the closure device, which may be a desirable property.

Generally, the interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to form the fastening strips. In most instances, the fastening strips are made from low density polyethylene. The selection of the appropriate thermoplastic material, however, is related to the particular design of the fastening strips, the Young's Modulus of the thermoplastic material, and the desired elasticity and flexibility of the strips.

When the interlocking fastening strips of the present invention are used in a sealable bag, the fastening strips and the films that form the side walls of the bag may be conveniently manufactured from heat sealable material. In this way, the bag may be economically formed by using an aforementioned thermoplastic material and by heat sealing the fastening strips to the bag. In most instances, the bag is made from a mixture of high pressure, low density polyethylene and linear, low density polyethylene.

The interlocking fastening strips may be manufactured by extrusion or other known methods. For example, the closure device may be manufactured as individual fastening strips for later attachment to the side walls of the bag or may be manufactured integrally therewith. In addition, the fastening strips may be manufactured with or without flange portions on one or both of the fastening strips depending upon the intended use of the closure device or expected additional manufacturing operations.

Generally, the closure device can be manufactured in a variety of forms to suit an intended use. In practicing the present invention, the closure device may be integrally formed on the opposing side walls of the container or bag, or connected to the container by way of any known method. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

In summary, the present invention discloses a closure device for use with storage containers, such as plastic bags. The closure device comprises interlocking fastening strips having first and second ends and a slider member movably installed upon the interlocking fastening strips. The slider member facilitates the occlusion of the interlocking fastening strips when moved towards the first end thereof and facilitates the deocclusion of the interlocking fastening strips when moved towards the second-end thereof. The slider member includes a pair of spaced-apart side walls which are positioned on opposite sides of the interlocking fastening strips and an intermediate body portion therebetween which is positioned upon the interlocking fastening strips. The slider member also includes notches formed therein which are adapted to interact with and engage cooperating protrusions formed on the interlocking fastening strips at the first and second ends thereof to obstruct movement of the slider member beyond the first and second ends.

While the present invention has been described and disclosed in connection with certain illustrated embodiments, it will be understood, of course, that there is no intention to limit the invention to the disclosed structural forms. On the contrary, the intention is to cover to cover all modifications, alternative constructions, and equivalents that fall within the scope and spirit of the present invention as defined by the following claims. In addition, all references and co-pending applications cited herein are hereby incorporated by reference in their entireties.

What is claimed is:

1. A closure device comprising:

interlocking fastening strips having first and second ends, said first end having a protrusion formed adjacent a top portion thereof;

a slider member movably installed upon the interlocking fastening strips, the slider member facilitating the occlusion of the interlocking fastening strips when moved towards the first end thereof, the slider member having a pair of spaced-apart side walls which are positioned on opposite sides of the interlocking fastening strips, an intermediate body portion between the side walls which is positioned upon the interlocking fastening strips, and a notch formed in said intermediate body portion; and wherein at least one of said notch or said protrusion having a pair of spaced apart contact surfaces which interact with and wedgingly engage respective contact portions of the other of said notch or protrusion to obstruct further movement of the slider member beyond said first end.

2. The invention as in claim 1 wherein:

the slider member includes a second notch;

said second end of said fastening strips includes a second protrusion; and wherein at least one of said second notch or said second protrusion having a pair of spaced apart contact surfaces which interact with and wedgingly engage respective contact portions of the other of said second notch or second protrusion to obstruct further movement of the slider member beyond said second end.

3. The invention set forth in claim 1, wherein the spaced apart contact surfaces include opposed exterior sides of the protrusion and the respective contact portions include opposed interior sides of the notch, wherein the opposed exterior sides of the protrusion become wedged between the opposed interior sides of the notch to restrict disengagement of the slider member from the interlocking fastening strip when the slider member is moved toward the first end thereof.

4. The invention set forth in claim 1, wherein the notch of the slider member has a generally V-shaped configuration that contains the spaced apart contact surfaces.

5. The invention set forth in claim 4, wherein the spaced apart contact surfaces of the generally V-shaped notch comprise opposed interior sides.

6. The invention set forth in claim 5, wherein the opposed interior sides of the notch are substantially planar.

7. The invention set forth in claim 5, wherein the opposed interior sides of the notch are rectangular in configuration and converge along a generally vertical internal corner.

8. The invention set forth in claim 5, wherein the opposed interior sides of the notch are triangular in configuration and converge along an inclined internal corner.

9. The invention set forth in claim 8, wherein the protrusion has a pair of opposed exterior sides that comprise the spaced apart contact surfaces and an edge portion therebetween.

10. The invention set forth in claim 9, wherein the edge portion of the protrusion is inclined with respect to the interlocking fastening strip.

11. The invention set forth in claim 10, wherein the edge portion of the protrusion slopes upwardly and outwardly with respect to the interlocking fastening strip.

12. The invention set forth in claim 9, wherein the opposed exterior sides of the protrusion are substantially parallel with respect to each other.

13. The invention set forth in claim 9, wherein the opposed exterior sides of the protrusion are generally triangular in configuration.

14. The invention set forth in claim 3, wherein the protrusion formed on the interlocking fastening strip has a generally wedge-shaped configuration that contains the spaced apart contact surfaces.

15. The invention set forth in claim 14, wherein the protrusion has a pair of opposed exterior sides that comprise the spaced apart contact surfaces and an edge portion therebetween.

16. The invention set forth in claim 14, wherein the opposed exterior sides of the protrusion flare outwardly with respect to each other and the interlocking fastening strip.

17. The invention set forth in claim 15, wherein the edge portion of the protrusion slopes upwardly and outwardly with respect to the interlocking fastening strip.

18. The invention set forth in claim 16, wherein the notch of the slider member has a partially curved configuration.

19. The invention set forth in claim 18, wherein the notch has a pair of opposed interior sides and an intermediate arcuate portion therebetween.

20. The invention set forth in claim 19, wherein the opposed interior sides of the notch are substantially parallel with respect to each other.

21. The invention set forth in claim 16, wherein the notch has a generally rectangular configuration.

22. The invention set forth in claim 21, wherein the notch has a pair of opposed interior sides and an intermediate portion therebetween.

23. The invention set forth in claim 22, wherein the opposed interior sides of the notch are substantially parallel with respect to each other.

24. The invention set forth in claim 22, wherein the intermediate portion and the opposed interior sides of the notch are substantially planar.

25. The invention set forth in claim 22, wherein the intermediate portion and the opposed interior sides of the notch have generally rectangular configurations.

26. The invention set forth in claim 22, wherein the intermediate portion and the opposed interior sides of the notch converge along substantially vertical internal corners.

27. The invention set forth in claim 13, wherein the intermediate portion of the notch includes substantially vertical external corners.

28. A storage container comprising:

a pair of complementary sheets;

a first fastening strip disposed along an edge portion of one sheet;

a second fastening strip disposed along an edge portion of the other sheet and disposed to interlockingly engage the first fastening strip to form a pair of interlocking fastening strips having first and second ends, wherein said first end having a protrusion formed adjacent a top portion thereof, and a slider member movably disposed upon the first and second fastening strips, the slider member facilitating the occlusion of the interlocking fastening strips when moved towards a first end thereof, the slider member having a pair of spaced-apart side walls which are positioned on opposite sides of the interlocking fastening strips, an intermediate body portion between the two side walls which is positioned upon the interlocking fastening strips, and a notch formed in the intermediate body portion; and wherein at least one of said notch or said protrusion having a pair of spaced apart contact surfaces which interact with and wedgingly engage respective contact portions of the other of said notch or protrusion to obstruct further movement of the slider member beyond said first end.

29. The invention as in claim 28 wherein:

the slider member includes a second notch;

said second end of said fastening strips includes a second protrusion; and wherein at least one of said second notch or said second protrusion having a pair of spaced apart contact surfaces which interact with and wedgingly engage respective contact portions of the other of said second notch or second protrusion to obstruct further movement of the slider member beyond said second end.

30. The invention set forth in claim 28, wherein the spaced apart contact surfaces include opposed exterior sides of the protrusion and the respective contact portions include opposed interior sides of the notch, wherein the opposed exterior sides of the protrusion become wedged between the opposed interior sides of the notch to restrict disengagement of the slider member from the interlocking fastening strip when the slider member is moved toward the first end thereof.

31. The invention set forth in claim 28, wherein the notch of the slider member has a generally V-shaped configuration that contains the spaced apart contact surfaces.

32. The invention set forth in claim 31, wherein the generally V-shaped notch has opposed interior sides that comprise the spaced apart contact surfaces.

33. The invention set forth in claim 32, wherein the opposed interior sides of the notch are substantially planar.

34. The invention set forth in claim 32, wherein the opposed interior sides of the notch are rectangular in configuration and converge along a generally vertical internal corner.

35. The invention set forth in claim 32, wherein the opposed interior sides of the notch are triangular in configuration and converge along an inclined internal corner.

36. The invention set forth in claim 35, wherein the protrusion has a pair of opposed exterior sides and an edge portion therebetween.

37. The invention set forth in claim 36, wherein the edge portion of the protrusion is inclined with respect to the interlocking fastening strip.

38. The invention set forth in claim 37, wherein the edge portion of the protrusion slopes upwardly and outwardly with respect to the interlocking fastening strip.

39. The invention set forth in claim 36, wherein the opposed exterior sides of the protrusion are substantially parallel with respect to each other.

40. The invention set forth in claim 36, wherein the opposed exterior sides of the protrusion are generally triangular in configuration.

41. The invention set forth in claim 30, wherein the protrusion formed on the interlocking fastening strip has a generally wedge-shaped configuration that contains the spaced apart contact surfaces.

42. The invention set forth in claim 41, wherein the protrusion has a pair of opposed exterior sides that comprise the spaced apart contact surfaces and an edge portion therebetween.

43. The invention set forth in claim 41, wherein the opposed exterior sides of the protrusion flare outwardly with respect to each other and the interlocking fastening strip.

44. The invention set forth in claim 42, wherein the edge portion of the protrusion slopes upwardly and outwardly with respect to the interlocking fastening strip.

45. The invention set forth in claim 43, wherein the notch of the slider member has a partially curved configuration.

46. The invention set forth in claim 45, wherein the notch has a pair of opposed interior sides and an intermediate arcuate portion therebetween.

47. The invention set forth in claim 46, wherein the opposed interior sides of the notch are substantially parallel with respect to each other.

48. The invention set forth in claim 43, wherein the notch has a generally rectangular configuration.

49. The invention set forth in claim 48, wherein the notch has a pair of opposed interior sides and an intermediate portion therebetween.

50. The invention set forth in claim 49, wherein the opposed interior sides of the notch is substantially parallel with respect to each other.

51. The invention set forth in claim 49, wherein the intermediate portion and the opposed interior sides of the notch are substantially planar.

52. The invention set forth in claim 49, wherein the intermediate portion and the opposed interior sides of the notch have generally rectangular configurations.

53. The invention set forth in claim 49, wherein the intermediate portion and the opposed interior sides of the notch converge along substantially vertical internal corners.

54. The invention set forth in claim 49, wherein the intermediate portion of the notch includes substantially vertical external corners.

55. A slider member for facilitating occlusion of interlocking fastening strips when moved towards the first end of the fastening strips, the slider member comprising:

a pair of spaced-apart side walls which are adapted to be installed on opposite sides of interlocking fastening strips;

an intermediate body portion between the side walls which is adapted to be installed upon interlocking fastening strips; and a notch formed in said intermediate body portion, said notch has a generally v-shaped configuration that contains opposed contact surfaces that interact with and wedgingly engage respective contact portions of a cooperating protrusion formed on one of the interlocking fastening strips adjacent a top portion thereof at a first end thereof to obstruct further movement of the slider member beyond said first end.

56. The invention set forth in claim 55, wherein the spaced apart contact surfaces of the generally V-shaped notch comprise opposed interior sides.

57. The invention set forth in claim 56, wherein the opposed interior sides of the notch are substantially planar.

58. The invention set forth in claim 56, wherein the opposed interior sides of the notch are rectangular in configuration and converge along a generally vertical internal corner.

59. The invention set forth in claim 56, wherein the opposed interior sides of the notch are triangular in configuration and converge along an inclined internal corner.

60. The invention as in claim 55 wherein the slider member includes a second notch having a pair of spaced apart contact surfaces formed in said intermediate body portion thereof which is adapted to interact with and wedgingly engage respective contact portions of a second cooperating protrusion formed on one of the interlocking fastening strips at a second end thereof to obstruct further movement of the slider member beyond said second end.

* * * * *